United States Patent [19]

Colgate

[11] 4,370,077

[45] Jan. 25, 1983

[54] METHOD OF PRESSURIZING AND STABILIZING ROCK BY PERIODIC AND REPEATED INJECTIONS OF A SETTABLE FLUID OF FINITE GEL STRENGTH

[76] Inventor: Stirling A. Colgate, 4616 Ridgeway, Los Alamos, N. Mex. 87544

[21] Appl. No.: 175,047

[22] Filed: Aug. 4, 1980

[51] Int. Cl.[3] ..... E21D 19/00

[52] U.S. Cl. ..... 405/258; 299/16; 405/266

[58] Field of Search ..... 405/258, 259, 266, 263, 405/269; 166/283; 299/16

[56] References Cited

U.S. PATENT DOCUMENTS

| | | | |
|---|---|---|---|
| 2,233,872 | 3/1941 | Proctor | 405/266 |
| 2,434,301 | 1/1948 | Wertz | 405/266 |
| 2,947,146 | 8/1960 | Loofbourow | 405/266 X |
| 3,222,872 | 12/1965 | Larnefors et al. | 405/266 |
| 3,518,834 | 7/1970 | Gnaedinger et al. | 405/269 |
| 3,583,166 | 6/1971 | Graf | 405/266 |
| 3,934,420 | 1/1976 | Janelid et al. | 405/269 X |
| 4,084,381 | 4/1978 | Cain et al. | 405/266 |

*Primary Examiner*—Dennis L. Taylor

*Attorney, Agent, or Firm*—Brumbaugh, Graves, Donohue & Raymond

[57] ABSTRACT

A finite region of overpressure can be created in solid underground formations by the periodic injection of a fluid that has finite gel strength that subsequently, after each injection, partially sets—i.e., equivalently becomes a very much stronger gel. A region of overpressure is a region in which the static, locked in pressure is larger than what was there before. A region of overpressure can be used to prevent a roof of a tunnel from caving by adding compressive stresses in the roof. A sequence of regions of overpressure can be used to lift an arch or dome underground, squeeze off water or gas flows, stabilize dams, foundations, large underground rooms, etc. In general, the stress or pressure distribution in rock can be altered and engineered in a fashion that is more advantageous than what would have been the case without overstressing.

11 Claims, 3 Drawing Figures

METHOD OF PRESSURIZING AND STABILIZING ROCK BY PERIODIC AND REPEATED INJECTIONS OF A SETTABLE FLUID OF FINITE GEL STRENGTH

The Government has rights in this invention pursuant to Contract No. W-7405-ENG-36 awarded by the U.S. Department of Energy.

BACKGROUND OF THE INVENTION

Stirling A. Colgate U.S. Pat. No. 3,616,855 describes a method of creating a region of overpressure in an underground formation by pumping a settable fluid at high pressure into the formation at the point where the overpressure is desired. The fluid fractures the rock if the pressure is great enough and fills the crack. A period of static hold allows the fluid to set to a stronger solid. The normal stress in the fracture is increased because of the added volume. A subsequent fracture may or may not reopen the original fracture. If it reopens the original one, then the new added volume will further increase the normal stress and make the subsequent fracture more difficult until after some cumulative increment of stress, the fluid finds and fractures a new direction until it too has increased in stress to where either a still different direction is fractured, or the original one is fractured again. In this fashion, the fractures find the weakest point or direction; then the injected fluid increments the stress and thus converts the weak point into a strong one. This stochastic process will find and fill fractures in all directions from the injection point. The weakest direction is turned into the strongest, and a new weakest one is found. A volcano mountain is formed in the same fashion where each lava flow that breaks out the sides turns the last weak point into a stronger point by locking in the stress created by the fracture, flow and solidification of the lava.

SUMMARY OF THE INVENTION

Theoretical and experimental research relating to the underground stress engineering method of the Colgate patent has led to a more complete understanding of the method that enables, in accordance with the present invention, a selected overstress to be created in a selected volume.

The improved method is based upon the discovery of the relationships between the gel strength of the settable fluid, the bulk modulus of the rock in the formation to be stressed and the volume of the fluid pumped into the formation in each injection.

(1) The increment of pressure ($\Delta P$) added by each injection is approximately equal to the square root of the gel strength ($G_s$) of the fluid times the bulk modulus (B) of the rock;

i.e., $\Delta P \simeq (G_s B)^{\frac{1}{2}}$ (2) The total volume (V) of settable fluid to be pumped into the formation is equal to the volume of rock to be overstressed times the overstress desired ($\Delta P_{tot}$) divided by the bulk modulus (B) of the rock. (The volume of the overstressed rock can be considered as a spherical mass having a radius equal to the extent of excursion of the crack from the place of injection of the fluid, which can be termed the half crack length (L), and a length roughly equal to the radius. Therefore, the overstressed volume of rock is equal to $4\pi$ L 3/3.)

i.e., $V \simeq (4/3)\pi L^3 \Delta P_{tot}/B$

From the relationships described above, the gel strength and the volume of the setting fluid to be injected into the formation to obtain a desired overstress in a desired volume of rock can be determined. In particular, a gel is selected which has a gel strength approximately equal to the square of the desired stress increase divided by the bulk modulus of the rock. The volume of gel pumped into the rock in each injection is roughly equal to $L^3 (2G_s/B)^{\frac{1}{2}}$.

The number of injections of gel into the rock to produce a selected total overstress (S) in a volume of about $(4/3)L^3$ is roughly equal to $3S/(G_s B)^{\frac{1}{2}}$.

The improved method, according to the present invention, can be used to alter and engineer the stress or pressure distribution in rock over an underground room or tunnel, to squeeze off water or gas flow in rock, to lift an arch or dome underground and stabilize a building foundation, just to name a few examples.

In the more detailed description of the invention and some examples of its use, reference is made to the accompanying drawings.

MORE DETAILED DESCRIPTION OF THE METHOD

Fracturing With a Gel

The property of a gel that is unique for creating a stress is its finite resistance to flow at zero velocity. (Resistance to flow at finite velocity is described by viscosity.) Thus, a stress in a gel can be "locked-in" by allowing the gel to "set" after a finite time in a static condition. Typical examples are special grouts or catalytic polymerizing plastics. If a gel is forced into a channel of width W and length L, and arbitrarily large depth, then the pressure drop will be inversely proportional to the width, and proportional to both the length and gel strength G. Thus the pressure drop becomes:

$$\Delta P = 2G_s L/W. \quad (1)$$

This assumes that the flow is laminar, which is a good assumption because the equivalent viscosity is large and the flow velocity is small. $G_s$ is a measure of the shear strength of the gel and typically may be $10^{-2}$ to 1 PSI for useful application to stress engineering. For example, the familiar food gelatin has a gel strength of roughly 1 PSI.

If the channel of the above example (equation 1) is a fracture, then the pressure drop due to the injection of the gel will be exerted on the walls of the fracture and tend to push apart the fracture and widen the channel. The relationship between this widening of the channel and the properties of the gel, rock formation, and fracture are the key to stress engineering.

Figure 1:
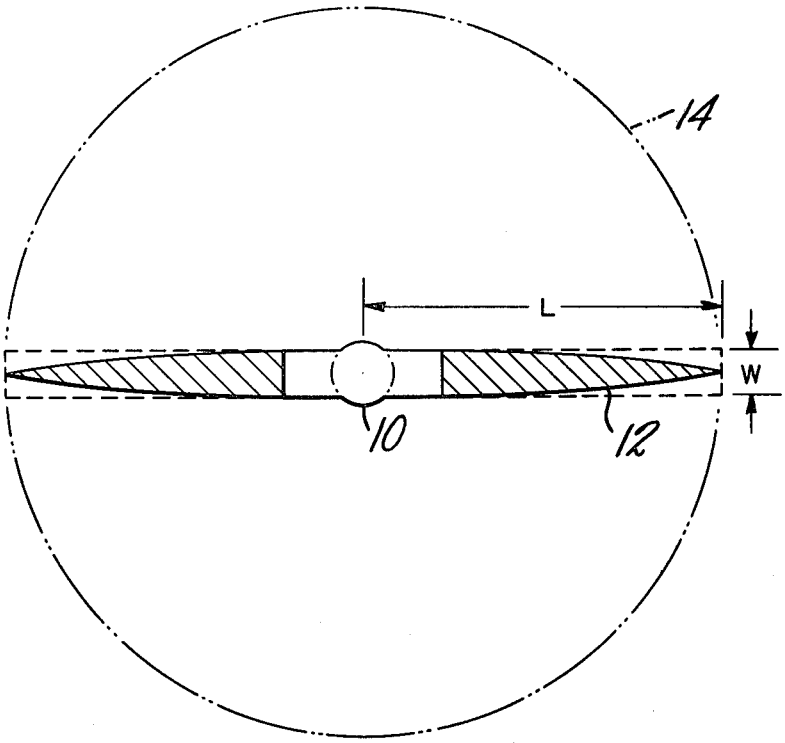
FIG. 1 is a diagram depicting a crack formed by injecting settable fluid into an underground formation.

A fracture is shown in FIG. 1 as viewed in the direction of a bore hole 10. The fracture 12 extends symmetrically either side of the bore hole to a half length L and to an arbitrary depth (into the paper) a distance larger than L. Thus, a semi-infinite cylindrical geometry is described. Compressive stress is induced in the formation because of the width of the fracture. The formation is compressed in the orthogonal direction to the plane of the fracture. The region effected by the compression created by the fracture will have the same cylindrical geometry (shown by phantom lines 14) and will roughly extend a radial distance corresponding to the crack half length L. Thus, if we approximate the fracture as a channel of constant width W, outlined by the dashed curve in FIG. 1, then the volume of the fracture, 2 L W per unit depth, is distributed as compressive stress in roughly a volume $\pi L^2$ per unit depth. Thus, if this added volume creates only compressive stress, the increment of pressure in the fracture will be:

$$\Delta P \cong \frac{\text{(volume added) (Bulk modulus)}}{\text{volume effected}} \cong \frac{2LWB}{\pi L^2} = \frac{WB}{\pi L} \quad (2)$$

where B is the bulk modulus. This is, of course, a gross approximation; real fractures have a more complicated shape determined by the rock strength that is described below. In addition, the pressure in the fracture or channel is an increment of pressure rather than an absolute value. In a rear case, the fracture is formed underground where there exists a static in situ pressure, usually the "overburden" pressure corresponding to the depth. This overburden pressure adds to the fracture pressure; hence the pressure added by the fracture is an increment of pressure.

If the fracture is made by pumping a gel at high pressure, then the pressure increment of equation 1 will hold open a fracture that has a normal stress described by equation 2. If equations 1 and 2 are equated, one obtains:

$$W/L = (\pi G_s/B)^{\frac{1}{2}},$$

$$\Delta P = 2G_sB/\pi = 1.13\ (G_sB)^{\frac{1}{2}} \quad (3)$$

These relations state that both the length to width ratio of a fracture as well as the increment of pressure created are both a constant independent of the volume of gel pumped into the fracture. This means that provided the gel strength and bulk modulus are constant, then the increment of pressure is a constant no matter how much gel is pumped. It is only when the gel sets to a solid that a new injection of gel will create a new fracture, thus adding an increment to the previous pressure.

Experimentation

In some experimental work, ½ gallon to 5 gallon guantities of a finite gel strength grout ($G_s \simeq 2/10$ PSI) were pumped into formations in a mine. Over many grout injections, the random incremental increase in the fracture pressure climbed roughly 500 to 5,000 psi per injection. If the bulk modulus is the average value $2\times10^6$ psi for hard rock, then from equation 3, $\Delta P \simeq 600$ psi. Furthermore, once injection started in a new fracture, the pressure would very seldom increase and more often decrease as the pumping continued. The decrease can be explained by either a new fracture direction or a fracture and flow opening up into regions beyond (larger L) those originally stressed and hence at a lower ambient stress. These experiments are strong evidence of the behavior described by equation 3. Both the increments of pressure occurred as expected, and this increment of pressure was independent of volume pumped, provided the volume was not significantly larger than the previous injection.

Procedure for Creating an Overstressed Region

One initially defines the region to be overstressed as extending some dimension L dependent upon the use. One further defines the overstress desired as some maximum value, $\Delta P_{tot}$, where this may be some multiple of the overburden pressure and or the rock strength. In general, the stress needed to hold the roof of a tunnel or drift is small, say one to several $\times 10^3$ psi. On the other hand, squeezing off a deep mine water flow or geopressurized brines may require $10\times$ this value. Then the total volume of gel or grout to be added becomes:

$$\Delta\ \text{Volume} = \frac{\text{(Volume overstressed)}\Delta P_{tot}}{B} \cong \frac{4}{3}\pi L^3 \Delta P_{tot}/B. \quad (4)$$

Ideally, one would like to create this overstress from three mutually perpendicular fractures, but in a real case the rock strength and heterogeneity would cause this to be unlikely. Hence, the formation should be fractured with roughly at least twice this number of injections—say six—so that there is a reasonable chance of the fractures exploring most directions. The volume pumped with each injection should then be $\simeq \Delta Vol/6$. Since some of these fractures will be in the same direction as the previous one, the average increment of pressure created per injection will be about $\Delta P_{tot}/3$. The required gel strength is then determined using equation 3. If such a gel can be made and pumped, it is what is used. If the $\Delta P_{tot} = 2000$ PSI, and $B = 2\times10^6$ PSI, for example, the required gel strength is $\simeq \frac{1}{8}$ PSI, a value similar to a soft grease. Air operated grease pumps are available for pumping such a gel, and such pumps were used in the mine tests described above. An increment of pressure of an average of about 350 PSI per injection is expected, but some fractured at 700 PSI and some near zero. Averaged over six injections, an overpressure of $\Delta P_{tot} \simeq 2000$ PSI should result.

The volume to be pumped per injection is then $\Delta Vol/6$, from equation 4. If the bulk modulus were smaller, or the desired $\Delta P_{tot}$ larger, then a larger volume would have to be pumped in a larger number of injections. Similarly, a weaker gel would require a larger number of injections of smaller volume each.

Practical Volumes

In drifting a tunnel to overstress the heading so that following each round an overpressure in the roof is created to prevent caving, then it is worthwhile to evaluate the economics of overstressing versus some other safety features like cribbing or rock bolting. For example, suppose a 20 foot diameter heading is being run, making 15 feet per round. The stressing method involves drilling ahead by the round depth (15 feet) slightly above the roof level and overstressing to roughly 2000 PSI. This ensures a compressive stress greater than the tensile strength of the rock and so ensures a residual of primarily compressive stresses. This is the optimum safe stress distribution in a roof. The hole 20 is drilled to a depth somewhat greater (say a foot) than the round depth, and a packer 22 is set to the depth of the round, 15 feet. The spherical region to be overstressed should be roughly the size of the drift, or 20 feet. The volume of rock affected is thus $(4/3)\pi r^3 \simeq 4000$ ft$^3$. The increment of volume to be added becomes $$\text{Vol} = \frac{\text{Volume} \times \Delta P_{tot}}{B} = 4 \text{ ft}^3.$$

This is only four sacks of cement and is a trivial expense in supplies compared to the labor and materials to advance such a drift. The elapsed time required to inject the grout is roughly six times the gel setting time (six injections with setting times between them). The pumping time for each injection of $\frac{2}{3}$ cubic feet ($\simeq$5 gallons) is at most one minute, requiring 5 HP. If the re-set time for the gel is ten times the pumping time, or 10 minutes per injection, the overstressing operation takes roughly an hour. The round can then be drilled and blasted immediately after stressing, because the grout will be further set and the transient stress of blasting is short enough in duration so that the set grout will not be squeezed out.

The cost overhead of an hour is small compared to that required for cribbing which is roughly $\frac{1}{2}$ to 1 times the labor required for a round and an additional equal cost for materials.

Embodiment of Overstressing a Tunnel

Figure 2:
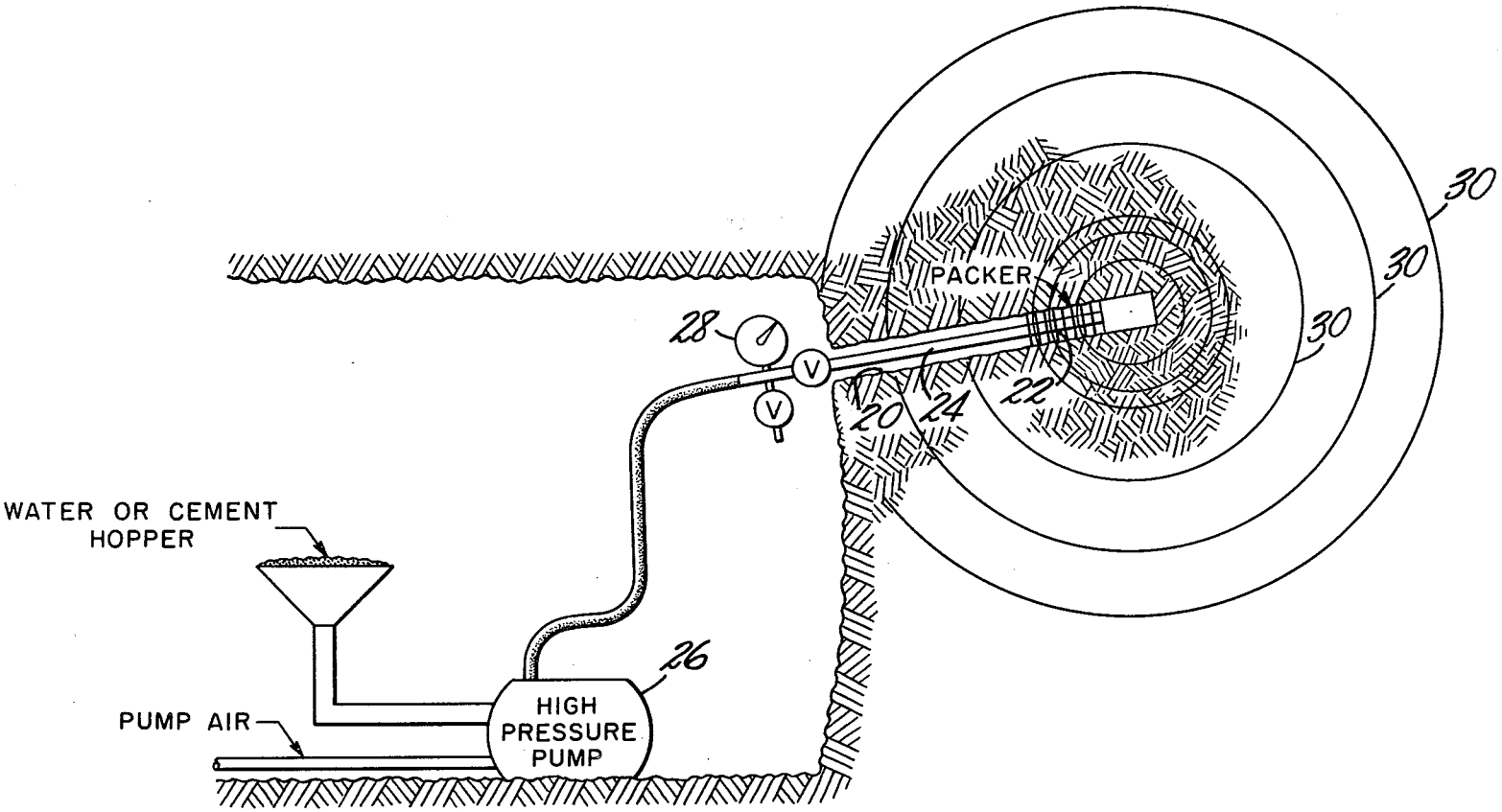
FIG. 2 is a pictorial illustration of the use of the method in pressurizing the roof of a tunnel to keep it from caving.

A typical embodiment of overstress for a mine or transportation tunnel is shown in FIG. 2 and is described above. Consider a typical tunnel of 10 feet (3.3 meters) diameter. The depth underground is not important to the technique assuming only that it is less than typical mines or tunnels of 10,000 feet or 3 kilometers. Down to this depth most rock is strong in compression compared to overburden pressure, 1000 PSI, and so overstressing just serves to lock in the rocks of the tunnel and does not attempt to distribute the compressive loads to a larger area (as would also be possible).

To lock in the rock surrounding the tunnel requires a pressure increase of only several thousand PSI, that is, enough additional compression in the rock such as to ensure that no single rock can be likely supported in tension (since the tensile strength of rock rarely exceeds 2,000 PSI). A rock that is supported in tension can always be prone to collapse—i.e., fall—because of fracture. A rock in compression is held in place regardless of fractures. That is, the mortar between the stones of a Roman arch does not support the arch; compressive stresses support the arch regardless of the mortar or any other presumed tensile strength.

In the tunnel the hole 20 is drilled and an injection pipe 24 set ahead and slightly above or at the level of the new tunnel roof. The depth of the hole is roughly the tunnel diameter—which is 10 feet (3 meters) in this case. The packer 22 is set around the injection pipe 24 roughly 10 hole diameters from the end of the hole. The packer can be of any standard type; frequently the compression of a stack of rubber washers or the hydraulic inflation of a liner is used, or the pipe can be set in the rock with quick setting resins as is current roof bolting practice. The distance of packers from the hole bottom is determined by the requirement to initially fracture the formation. If the length to diameter of the initial pressure region is large, i.e., $\geqq$10 fold, then the anisotropy of the stresses (inside the uniform stress region depicted by 30) ensures that the hole will fracture if the fluid pressure is 2,000 to 4,000 PSI greater than the overburden pressure. The first fracture is created by pumping water or oil by the same high pressure pump 26 that pumps the gel overstress fluid. The first fracture forms at a pressure (which can be read on the gauge 28) equal roughly to the overburden pressure plus some factor times the rock strength. Thus, if the tunnel is at, say, the 2,000 feet depth, then overburden pressure is 2,000 PSI and a fracture will form at 2,000 to 6,000 PSI depending upon previous fractures. Once a fracture is formed, then the acceptance pressure of the fracture fluid will be overburden pressure. Then the fluid is changed to the overpressure fluid of finite gel strength that will form the stress distribution outlined by the concentric circles 30.

A suitable settable fluid to use in the stress engineering method is a thick grout made up of 85% neat cement, preferably the fast setting variety known as #III Hy-Early which is a finer grind than normal cement. In addition, 15% plaster is used to give it gel properties. Calcium chloride up to 5% can be added to speed up the setting time if needed. Where the cement is mixed stochiametrically between the $CaSO_4$ plaster and the CaIII of the cement, it is known as "Regulated Fill Up," a cement made of Dowell Corporation. The volume of cement or gel fluid to be pumped is determined by equation 4 with equation 5 substituted for $\Delta P$. That is, the volume of grout pumped in each injection becomes:

$$\Delta\text{Vol} = 4/3\pi D^3 (G_s/B)^{\frac{1}{2}}.$$

For typical thick grout, the gel strength $G_s \simeq 1/10$ PSI and the bulk modulus, $B \simeq 2 \times 10^6$ PSI. The volume to be pumped becomes $\Delta\text{Vol} \simeq 10^{-3} D^3$ ft$^3$. Therefore, if the tunnel diameter is 10 feet and the overstressed region is the tunnel diameter, then each grout injection should be one cubic foot or 7.5 gallons. The period between injections should be 5 to 10 minutes, which is the typical time for such a grout to partially set. The increment of pressure for each injection will be $(G_s B)^{\frac{1}{2}} \simeq 450$ PSI.

If the original tunnel was at a depth of say 2,000 feet, then the first injection of grout will be at roughly 2,500 PSI and progressively increases with each injection. Of course, it must be recognized that previous fractures, altered stratigraphy and the like, will cause significant variations in the behavior outlined—like a factor of 2. If the ground is highly fractured, i.e., "bad" ground, then roughly double the number of injections will be required, and conversely rock that is geotechtonically prestressed will show an initial fracture pressure well above overburden pressure and the grout injection pressure will increase more rapidly.

Finally, there may be circumstances where a more rapid set time of the gel fluid is required than can be obtained by various grouts. In this case, the two component catalytically setting resins, such as epoxy or polystyrene, that are typically used to hold rock bolts in mines would be the preferred finite gel strength rapid setting fluid. In the case of such a rapid set, it may be advantageous to use two pumps and pipes, one for each component so that each resin component is separately injected into the end of the drill hole. Mixing then takes place in the rock and not inside the reuseable equipment. The decision to use grout or two-component resin is mostly one of the cost of materials versus convenience. Grout is, of course, cheaper, but mixing, cleaning and waiting for a set is inconvenient. Resins are more expensive, but if mixing is achieved down hole, then no mixing equipment, cleaning or extraneous holding period between injections is required.

Lifting of Underground Domes

A dome or arch-shaped cavern can be created underground by the combined effect of multiple overstressed regions. These, in turn, are created by drilling from the surface and by the periodic pumping of a finite gel strength fast setting fluid in the fashion previously described. The effect of the multiple overlapping regions is to create an arch of stress that partially lifts the overburden rock. If water or air is injected under pressure beneath this arch of stress, it will add to the lifting of the dome. If one were to pump the water or air without the arch of stress, the fluid would leak away to the surface and into the formation to no advantage.

Figure 3:
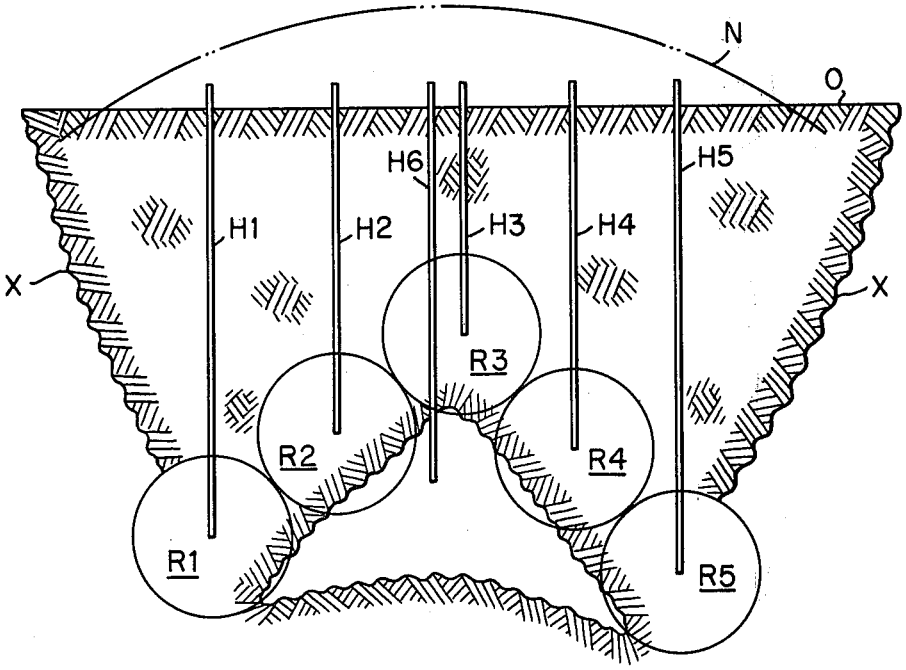
FIG. 3 illustrates a use of the method to overstress several regions to produce an arch or dome underground.

FIG. 3 shows a cross section of a cavern formed by multiple overstressed regions. Five overstressed regions, R1, R2 and R3, etc., are shown in this cross-section view, but in three dimensions a total of 14 is required (a central one, a ring of 4, and a ring of 9) for a dome or just 5 per section for an arch. The injection holes, H1, H2, etc., are drilled to a depth describing the height of the arch. In general, the height of the arch should be equal to the radius and so the outside ring holes H1 and H5 are drilled to a depth equal to one arch diameter D plus the dome depth d. The central hole H3 is then drilled to a depth $D/2+d$. The middle ring of holes R2 and R4 should then be drilled to a depth of $2D/3+d$. In general, the depth of the dome, d, should not be greater than its diameter D lest the coning of stresses increase the total force required to lift it.

The overstress in each region required to lift the dome will be that in each outer ring regions R1 and R5 considered as a footing. This force is larger than that corresponding to the overburden pressure times the area of the dome by the coning factor. Coning is the property of solid materials to distribute stresses laterally so that the stresses "cone" away from a source. This factor is roughly as if a conical plug of material were lifted above the dome at a 30° angle as shown in the drawing by the lines X. In a typical case where the depth is the same as the diameter, the coning effect roughly doubles the overburden force. Therefore, the overburden force becomes $2\pi(D/2)^2 d$, or if $d=D$, then $F=(\pi/2)D^3$. This must be supported by 9 stressed zones, R3 in a ring, of width $D\sqrt{2}/2$ or total area $\pi/4(D\sqrt{2}/2)^2\times 9\simeq 3D^2$. The pressure in each zone then becomes force/area$\simeq\frac{1}{2}D$. Not all of the outer ring of overstressed zones will be effective, and so it is conversative to say that the overpressure required will be the overburden pressure.

For example, let $d=D=1000$ feet. Then $\Delta P=1000$ PSI and $\Delta Vol=14$ regions$\times 4/3\ \pi(D\ 2/\sqrt{2})^3$ $(\Delta P/B)\simeq 10^{-2}D^3$ for $B=2\times 10^6$ PSI. This is the total volume of grout that would be needed to lift a dome, or 1/14 into each hole. The volume of rock that could be exposed for leaching or in situ mining would be of the order of $\frac{1}{3}D^3$, and so the ratio of prestressed material to exposed rock becomes 1 to 30. A hole H6 is drilled down below the dome to inject water or air to aid in the lift of the dome.

The lifting of the dome requires that each overstressed zone be continually overstressed, i.e., grout should be pumped repeatedly as well as the injection of water or air at the overburden pressure 1000 PSI in this case. Then the ground will lift from the original level 0 to a lifted new level N. While this is happening, the cavern C filled with water or air will form under the overstress regions as the dome is lifted by the combined stresses of the overstressed regions as well as the confined pressure of the lifting fluid. Thus, a dome or arch can be lifted by pumping predetermined amounts of a finite gel strength fast setting grout or fluid from the surface into a multiple of drill holes.

I claim:

1. In a method of increasing the stress in a body of consolidated material by repeatedly fracturing the material with a settable gel, the improvement wherein for a selected increase to be created in the stress in the material by each fracture a gel is selected which has a gel strength about equal to the square of the selected stress increase divided by the bulk modulus of the material and wherein the period between fractures is sufficient for the gel strength of the settable gel to increase by about an order of magnitude.

2. The improvement according to claim 1 wherein the volume of gel pumped into the material in each injection is about equal to $L^3\ (2G_s/B)^{\frac{1}{2}}$, where:

$L^3$ is a selected volume of the material into which the fractures are intended to extend, L being the linear extension of each fracture into the material from the region of injection of gel into the material;

$G_s$ is the gel strength of the gel; and

B is the bulk modulus of the material.

3. The improvement according to claim 2 wherein the number of injections of gel in a volume for each injection according to claim 2 into the material to provide a selected total stress increase S in a volume of about $(4/3)\pi L^3$ is about equal to $3S(G_sB)^{\frac{1}{2}}$.

4. The improvement according to any of claims 1, 2 or 3 wherein the material is an underground formation to be stabilized.

5. The improvement according to claim 4 wherein the underground formation at least partly bounds an underground cavity.

6. The improvement according to claim 4 wherein the volume of gel injected in any given injection is not substantially greater than the volume injected in any prior injection.

7. The improvement according to claim 4 wherein the volumes of gel injected in a series of injections are substantially equal.

8. In a method of forming an underground cavity by excavating underground material, the improvement wherein a region generally ahead of and above the next round of the cavity to be driven is repeatedly fractured with a settable gel to create an overstress in a selected volume to prevent caving as the cavity is driven into such round.

9. A method according to any of claims 1, 2 and 3, wherein the body of material is a region generally ahead of and above the next round of a cavity that is being excavated underground, and the stress in the material is increased to prevent caving as the cavity is driven into such round.

10. A method according to any of claims 1, 2 and 3, wherein the body of material is an underground zone subject to fluid flow and the stress in the zone is increased to at least partially block the fluid flow.

11. A method according to any of claims 1, 2 and 3, wherein the body of material is the ground site underlying a man-made structure and the stress in the material is increased to stabilize the site.

* * * * *